US007659486B2

(12) United States Patent
Valerio

(10) Patent No.: US 7,659,486 B2
(45) Date of Patent: Feb. 9, 2010

(54) METHOD AND APPARATUS FOR SORTING CONTAMINATED GLASS

(76) Inventor: Thomas A. Valerio, 3465 Hamilton Blvd. SW., Atlanta, GA (US) 30354

( * ) Notice: Subject to any disclaimer, the term of this patent is extended or adjusted under 35 U.S.C. 154(b) by 182 days.

(21) Appl. No.: 11/584,196

(22) Filed: Oct. 20, 2006

(65) Prior Publication Data

US 2007/0187305 A1 Aug. 16, 2007

(51) Int. Cl.
*B07C 5/342* (2006.01)
*B07C 5/00* (2006.01)

(52) U.S. Cl. ..... 209/581; 209/576; 209/580; 209/567; 209/571

(58) Field of Classification Search ..... 209/577, 209/580, 587
See application file for complete search history.

(56) References Cited

U.S. PATENT DOCUMENTS 3,448,778 A 6/1969 Ramsay
3,568,839 A 3/1971 Dunlea
3,588,686 A 6/1971 Lingmann et al.
3,670,969 A 6/1972 Terada
3,701,419 A 10/1972 Hutter et al.
3,702,133 A 11/1972 Vibert et al.
4,557,386 A 12/1985 Buckley et al.
4,563,644 A 1/1986 Lenander et al.
4,576,286 A 3/1986 Buckley et al.
4,718,559 A 1/1988 Kenny et al.
4,724,384 A 2/1988 Castovilly et al.
4,848,590 A 7/1989 Kelly
4,940,187 A 7/1990 Lee
5,022,985 A 6/1991 Nugent
5,169,073 A 12/1992 Marabini
5,209,355 A 5/1993 Mindermann
5,260,576 A 11/1993 Sommer
5,273,166 A 12/1993 Sawamura
5,314,071 A 5/1994 Christian
5,335,791 A * 8/1994 Eason ..... 209/588
5,344,026 A 9/1994 Booth et al.
5,413,222 A 5/1995 Holder
5,502,559 A * 3/1996 Powell et al. ..... 356/73
5,555,324 A 9/1996 Waxman et al.
5,555,984 A 9/1996 Sommer
5,632,381 A 5/1997 Thust et al.
5,667,151 A 9/1997 Miura et al.
5,801,530 A 9/1998 Crosby
5,829,600 A 11/1998 Jordan et al.
6,100,488 A 8/2000 Satake et al.
6,112,903 A 9/2000 Kimmel
6,124,560 A 9/2000 Roos
6,144,004 A * 11/2000 Doak ..... 209/581
6,191,580 B1 2/2001 Guichard
6,199,779 B1 3/2001 Mosher
6,313,422 B1 11/2001 Anibas
6,420,866 B1 7/2002 Goldberg et al.
6,497,324 B1 * 12/2002 Doak et al. ..... 209/522

(Continued)

*Primary Examiner*—Patrick H Mackey
*Assistant Examiner*—Terrell H Matthews
(74) *Attorney, Agent, or Firm*—King & Spalding

(57) ABSTRACT

A method, apparatus and system for sorting contaminated glass from a stream of glass particles used light of a wavelength suited to inducing fluorescence in the contaminated glass pieces. Automatic cleaning mechanisms are included in some embodiments to facilitate removal of coatings which would prevent the contaminated particles from fluorescing. The identified particles are then automatically separated from the remaining particles.

5 Claims, 3 Drawing Sheets

U.S. PATENT DOCUMENTS 6,696,655 B2 2/2004 Harbeck et al.
6,914,678 B1 * 7/2005 Ulrichsen et al. ..... 356/429
7,351,376 B1 * 4/2008 Quake et al. ..... 422/100
7,351,929 B2 * 4/2008 Afsari et al. ..... 209/580
7,354,733 B2 * 4/2008 Bukshpan et al. ..... 435/28
2001/0045378 A1 11/2001 Charles et al.
2002/0074274 A1 6/2002 Pegga
2004/0144693 A1 7/2004 Tse

* cited by examiner

METHOD AND APPARATUS FOR SORTING CONTAMINATED GLASS

FIELD OF THE INVENTION

The present invention relates generally to methods, techniques and apparata for recycling waste materials, and more particularly relates to methods, techniques and apparata for recycling waste glass, including contaminated glass.

BACKGROUND OF THE INVENTION

CRTs and other obsolete electronics account for a significant and rapidly increasing share of the solid waste generated by many different societies. From current estimates of 75,000 tons per year, the volume of this waste was expected to reach as much as 300,000 tons annually by 2005. The already increasing rates of discard will be exacerbated by the disposal of older units in favor of emerging technologies such as flat panel screens, high definition television (HDTV) and DVD players.

A cathode ray tube ("CRT") is the main component in older televisions and computer monitors. The CRT is a specialized vacuum tube in which images are produced when an electron beam internal to the tube is scanned back and forth across a phosphorescent surface on the inside front of the tube. Color CRT's have phosphor screens using multiple beams of electrons to display millions of colors. The CRT itself appears in the unit as a funnel shaped, leaded glass tube, typically with a metal frame inside. Most CRT's contain lead, which is well known to be a contaminant in many instances, and some CRT's can contain up to several pounds of lead, which may be in the form of lead oxide.

If the lead bearing glass is broken up and the lead oxide is exposed to an acidic environment, lead can be leached out of the glass. Because many CRT units are disposed of in landfills, those landfills may potentially be exposed to high levels of lead, which may leach to the water table and elsewhere in the environment.

In addition, the interior coatings of older television CRTs may also contain high levels of cadmium compounds, which may also be contaminants. These cadmium compounds can also be released from the CRT, and can contaminate the ground water, among other things.

CRTs may also contain various other contaminants, as shown in Table 1. It is highly desirable to avoid disposing of CRTs in a landfill by recycling the components. One method for recycling the components of the CRT is to break or shred the units into small pieces which are made of a single material, e.g., metal, plastic, or glass. The shredding can be performed by various means including automatic hammers, saws, blades or similar devices. These smaller pieces are then sorted according to material. For example, the ferrous metal components can be sorted from non-ferrous metals, plastic and glass by magnetic filtration. Other techniques may be used to sort the glass from the other components.

Based on a typical desktop computer and 14" monitor weighing ~60 lbs. Table presented in: Microelectronics and Computer Technology Corporation (MCC). 1996. Electronics Industry Environmental Roadmap. Austin, TX.

| Name | Content (% of total weight) | Actual Weight Content (pounds) | Recycling Efficiency |
|---|---|---|---|
| Silica | 24.8803 | 15 | 0% |
| Plastics | 22.9907 | 13.8 | 20% |
| Iron | 20.4712 | 12.3 | 80% |
| Aluminum | 14.1723 | 8.5 | 80% |

-continued

Based on a typical desktop computer and 14" monitor weighing ~60 lbs. Table presented in: Microelectronics and Computer Technology Corporation (MCC). 1996. Electronics Industry Environmental Roadmap. Austin, TX.

| Name | Content (% of total weight) | Actual Weight Content (pounds) | Recycling Efficiency |
|---|---|---|---|
| Copper | 6.9287 | 4.2 | 90% |
| Lead | 6.2988 | 3.8 | 5% |
| Zinc | 2.2046 | 1.32 | 60% |
| Tin | 1.0078 | 0.6 | 70% |
| Nickel | 0.8503 | 0.51 | 80% |
| Barium | 0.0315 | <0.1 | 0% |
| Manganese | 0.0315 | <0.1 | 0% |
| Silver | 0.0189 | <0.1 | 98% |
| Beryllium | 0.0157 | <0.1 | 0% |
| Cobalt | 0.0157 | <0.1 | 85% |
| Tantalum | 0.0157 | <0.1 | 0% |
| Titanium | 0.0157 | <0.1 | 0% |
| Antinomy | 0.0094 | <0.1 | 0% |
| Cadmium | 0.0094 | <0.1 | 0% |
| Bismuth | 0.0063 | <0.1 | 0% |
| Chromium | 0.0063 | <0.1 | 0% |
| Mercury | 0.0022 | <0.1 | 0% |
| Germanium | 0.0016 | <0.1 | 0% |
| Gold | 0.0016 | <0.1 | 99% |
| Indium | 0.0016 | <0.1 | 60% |
| Ruthenium | 0.0016 | <0.1 | 80% |
| Selenium | 0.0016 | <0.1 | 70% |
| Arsenic | 0.0013 | <0.1 | 0% |
| Gallium | 0.0013 | <0.1 | 0% |
| Palladium | 0.0003 | <0.1 | 95% |
| Vanadium | 0.0002 | <0.1 | 0% |
| Europium | 0.0002 | <0.1 | 0% |
| Niobium | 0.0002 | <0.1 | 0% |
| Yttrium | 0.0002 | <0.1 | 0% |

After the glass has been sorted from the other CRT components, the glass must be sorted based upon either lead content, or upon a similar criteria which may, for example, be based on a different contaminant. Such sorting has, in the past, been largely performed by hand, and therefore is slow and prohibitively costly for most purposes. As a result, there has been a long felt, and growing, need for a system, method and apparatus which is capable of sorting such contaminated glass in a more automated fashion.

SUMMARY OF THE INVENTION

In many applications for recycled glass, glass containing lead oxide cannot be mixed together with non-leaded glass. Therefore, in accordance with the present invention, separation of the contaminated glass, for example leaded glass, is performed using an optical system in which UV light is directed at the glass. The contaminants in the glass typically fluoresce at particular wavelengths, such that glass which is illuminated by appropriate wavelengths emits a characteristic wavelength which can readily be detected by a sensor.

In a typical arrangement, the glass has deposited thereon one or more layers of coatings. In one embodiment, the glass is cleaned so that at least a small portion of the glass coatings are removed to expose a clean portion of either the surface or a surface edge. The cleaning may be performed by wire brushing, sand blasting, tumbling, chemical etching or cleaning, or any other process suitable for removing the coatings on the glass in at least a portion of the surface. The cleaned glass pieces are then exposed to light of an appropriate wavelength, identified, and removed from the operating surface such as a conveyor belt by an automated means as described in greater detail in the Detailed Description of the Invention, hereinafter. In particular, the glass to be sorted typically contains a portion that will fluoresce upon illumination at the right wavelength, permitting a sensor to detect the glass pieces of interest. The system of the present invention can also include, in at least some embodiments, a mapping system which permits the location of each identified glass piece to be maintained, thereby allowing those pieces to be sorted at a subsequent step.

These and other aspects of the invention will be better appreciated from the following Detailed Description of the Invention, taken together with the appended Figures as described below.

THE FIGURES

DETAILED DESCRIPTION OF THE INVENTION

Figure 1:
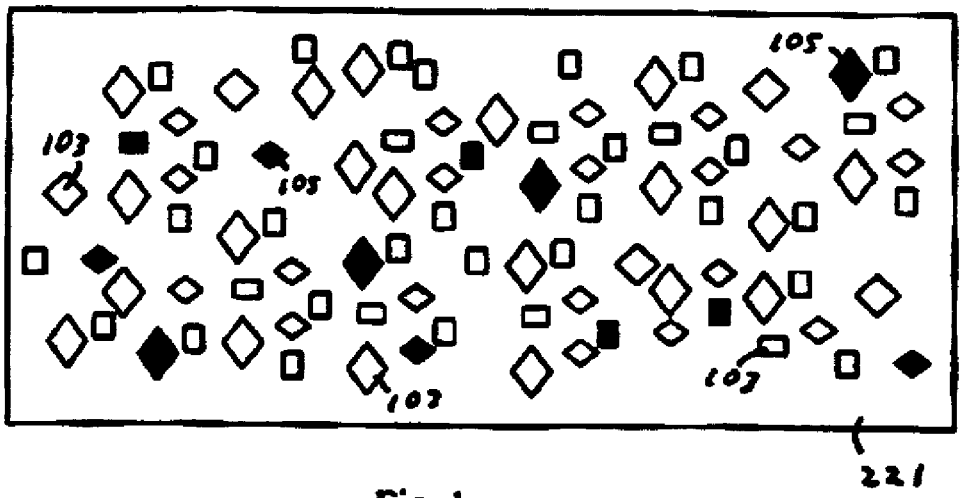
FIG. 1 shows in top plan view a conveyor carrying thereon an exemplary arrangement of glass pieces, some of which are contaminated.

With reference to FIG. 1, a carrier 221 is shown in top plan view, on top of which rest a plurality of glass pieces of at least two types, indicated by 103 and 105, waiting to be sorted. The carrier will be, in most cases, a conveyor belt or similar apparatus by which a continuous stream of glass pieces to be sorted is moved below a detection apparatus in accordance with the invention, as described hereinafter. However, for some implementations, the carrier can be implemented in other forms, such as a table, and therefore the carrier is not to be limited to a conveyor belt.

The glass pieces 103 and 105 typically differ from one another in that at least one of the types of glass pieces contain materials that are cause them to be considered contaminated, or at least different in some material way from the other types of glass pieces resting on the carrier. While only two types of glass pieces are shown in FIG. 1, for the sake of simplicity, it will be appreciated that the present invention will work with any number of glass pieces as long as the glass pieces of interest different in some identifiable way from the remainder of the pieces.

For the sake of simplicity, the present invention is explained in the context of sorting glass which contains lead from glass that does not contain lead. As noted previously, lead can have a deleterious effect on the environment, and leaded glass is frequently considered contaminated. However, it will be appreciated that, while the example of leaded glass will be used hereinafter for purposes of explanation, the use of lead is just an example of one embodiment of the invention, and is not limiting. For purposes of the present disclosure, glass type 103 is designated as not containing lead, while glass type 105 is designated as containing lead.

It is known that leaded glass 105 contains barium and strontium, and some unleaded glass may have high levels of barium and/or strontium. In response to illumination by UV light (which has a wavelength between 10 nm and 400 nm), barium and strontium in the glass 105 fluoresce by emitting light having a wavelength between 400 and 510 nm. In contrast, most unleaded glass 103 which does not contain either barium or strontium does not fluoresce and so does not emit any light in this wavelength range. Based upon this light output, the pieces of glass 105 that fluoresce can be separated from the non-leaded glass 103. Visible light has wavelengths between 400 and 750 nm. Because the fluorescence of the glass 105 is in the visible spectrum, it is possible for people to observe the light output from glass pieces 105. However, this human observation is not recommended without appropriate protection because observing the fluorescent emissions is likely to require exposure to the UV light illuminating the glass. It is well-known that UV radiation can cause serious injury to the eyes and skin. For protection, the carrier can be enclosed within a chamber that prevents UV light from escaping. In addition, because barium and strontium fluoresce in response to UV light of a wavelength on the order of 254 nm, in some embodiments it is desirable to include a notch filter which prevents the emission of UV light not substantially at 254 nm.

The characteristic of absorbing a first wavelength of light and emitting second wavelength of light that is different than the first wavelength is known as fluorescence. A fluorescent substance converts light in a certain sense before it reradiates it. Following the optical rule of Stokes, the incident first wavelength of light is converted into a second wavelength of light that is larger in wave length. Here the incident ultraviolet light of 254 nm wavelength, which is invisible to humans, is converted into visible light having a longer wavelength 400-510 nm.

According to quantum theory, fluorescence is linked to a process in the atom, which only occurs when the atom under consideration takes in a definite quantity of energy. If the emitted fluorescent light has the frequency $\nu_a = c/\lambda_a$ (c=velocity of light), this energy must be at least be $h\nu_a$ (h=Planck's active quantum). If the light irradiated has the wave length $\lambda_a$, it can only introduce the energy $h\lambda_e$ into the individual atom, since this is the magnitude of the quanta, out of which the energy of the light of that frequency is composed. Hence, fluorescence can only occur, when $h\nu_e > h\nu_a$ or when $\nu_e > \nu_a$ and $\lambda_e < \lambda_a$.

Figure 2:
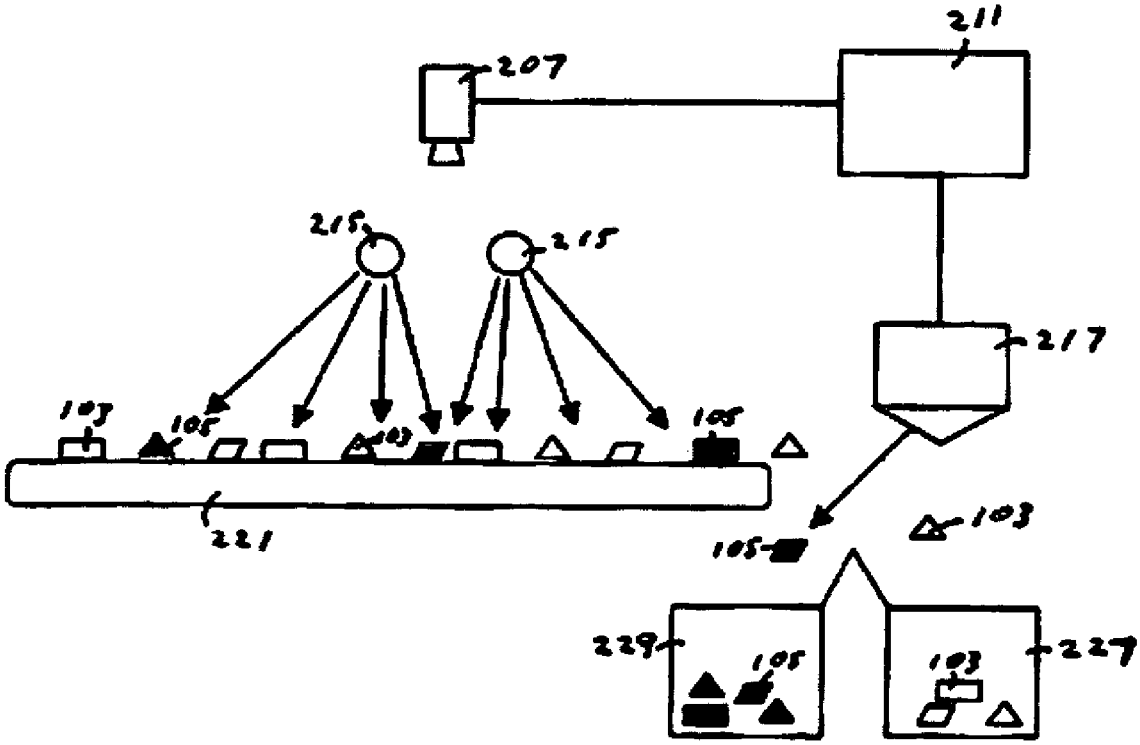
FIG. 2 shows in side elevational view the functional blocks of a system for identifying and sorting contaminated glass in accordance with the present invention.

Referring next to FIG. 2, a system in accordance with the present invention can be better appreciated. The pieces of glass of types 103 and 105 rest on carrier 221, which may for the present example be understood to be a conveyor belt. At an appropriate point on the path of the conveyor 221, the glass pieces 103 and 105 are illuminated by UV lamps 215. The glass pieces 103 fluoresce, and that fluorescent emission is detected by optical sensor 207, which may for example be one or more cameras or one or more optical sensors, and may for example be arranged in an array extending across all or a portion of the carrier 221. For safety and efficiency, cameras or optical sensors 207 which can be used to detect the leaded glass can include a charge-coupled device (CCD). A CCD is the sensor used in digital cameras and video cameras. The CCD 207 is similar to a computer chip, which senses light focused on its surface, like electronic film. Numerous other types of electronic optical sensors exist, including Complementary Metal-Oxide Semiconductor (CMOS) photodetectors. It will be appreciated that, while specific examples of photosensors are given herein, any form of photodetector suited to detecting the light emitted from the glass type 103 may be used, depending upon the remainder of the implementation. In some implementations, the sensors provide their output to a computer 211 programmed to distinguish different colors and wavelengths of visible light. By imaging a surface with the mixed leaded glass 103 and unleaded glass 105, the combination of the optical sensor 207 and computer 211 can identify the locations of the leaded pieces 105 on the carrier 221.

In an alternative embodiment, a filter is used with the optical sensor 207. The filter may remove all light that is outside of the 400-510 nm range of wavelengths. Dichroic color filters may be used to block all light outside this range of wavelengths. By filtering the light in this manner, only the light emitted from the leaded glass 105 will be detected by the optical sensor 207. Thus, when the pieces of glass 103, 105 are imaged by the camera 207, the leaded glass 105 will be illuminated while the unleaded glass 103 will remain dark. This distinction between the leaded glass 105 and unleaded glass 103 simplifies the sorting process because the camera 207 and software do not have to distinguish color and can simply distinguish illuminated from non-illuminated pieces of glass. For example, the leaded glass 105 images are then digitized through a computer program algorithm and converted into a grayscale image at real time at the known 400-510 nm wavelength. The contaminated leaded glass 105 can then identified by the computer and the location of the leaded glass 105 can be determined. In the preferred embodiment, this filter is a notched type filter which only allows light having wavelengths between 400-510 nm to pass through to the camera 207. In yet another embodiment, several cameras 207 can be used together with different optical filters.

Once these leaded glass pieces 105 have been identified they are then removed from the surface to separate the leaded glass 103 and unleaded glass 105. The removal process can be performed by any suitable device, including vacuum, mechanical, pneumatic, hydraulic, and so on. For example, a vacuum hose can be positioned over the detected location of the leaded glass 105 with robotic arms and the vacuum can be actuated to remove the leaded glass piece. Still other alternative embodiments exist, such as: air jets directed at the leaded glass, adhesive contact, grasping with a robotic clamping device, a sweeping mechanism or any other device which can displace the leaded glass 105. In general, it is more efficient to remove the leaded glass pieces 105 because there are typically more non-leaded glass pieces 103 produced by a shredded or broken CRT tube. However, it is also possible to remove the unleaded glass pieces 103. After the leaded glass pieces 105 have been separated from a mixture of glass pieces 103, 105 on the carrier 221, the unleaded glass 103 is removed from the surface and a new batch of mixed glass 103, 105 is laid out.

While the arrangement of FIGS. 1 and 2 can work with a carrier 221 configured as a fixed table, a more efficient approach for sorting the leaded glass pieces 105 is through an automated system that integrates a moving conveyor belt 221 with one or more CCD cameras or other optical sensor(s) 207, which in some arrangements are configured as an array, a computer 211 and a sorting mechanism. In this embodiment, the mixed glass 103, 105 is placed onto the moving conveyor belt 221 which causes the glass pieces 103, 105 to travel under the UV light source 215. The optical sensor 207 is mounted over the conveyor belt and detects moving position of the leaded glass pieces 105. The positions of the leaded glass pieces 105 are fed to the computer 211. By knowing the positions of the leaded glass pieces 105 and the speed of the conveyor belt 221, the computer 211 can determine the time and position across the belt 221 that the leaded glass pieces 105 will travel. For example, the computer 211 can predict when and where a leaded glass piece 105 will fall off the end of the conveyor belt 221. With this information, the computer 211 can then instruct the sorting mechanism 217 to separate the leaded glass 105 as it falls off the conveyor belt 221.

Various sorting mechanisms 217 may be used. In an embodiment, an array of air jets 217 is mounted at the end of the conveyor belt 221. The array of air jets 217 is mounted above the end of the conveyor belt 221 and has multiple air jets mounted across the conveyor belt 221 width. The computer 211 tracks the position of the leaded glass pieces 105 and transmits a control signal to actuate the individual air jet 217 corresponding to the position of the leaded glass pieces 105 as they fall off the end of the conveyor belt 221. The air jets 217 deflect the leaded glass pieces 105 and cause them to fall into a leaded glass collection bin 229. The air jets 217 are not actuated when unleaded glass 103 falls off the conveyor belt 221 and the unleaded glass pieces 103 fall off the end of the conveyor belt 221 into an unleaded glass bin 227.

Again, the array of air jets 217 is just one type of mechanism that can be used to sort the glass pieces 103, 105. It is contemplated that various other sorting mechanisms may be used. An array of vacuum hoses may be positioned across the conveyor belt and the computer may actuate a specific vacuum as the leaded glass passes under the corresponding hose. Alternatively, robotic arms with suction, adhesive, grasping or sweeping mechanisms may be used to remove the leaded glass as it moves under a sorting region of the system. An array of small bins may be placed under the end of the conveyor belt and when a leaded glass piece 105 is detected the smaller bin may be placed in the falling path to catch the leaded glass 105 and then retracted. All unleaded glass 103 would be allowed to fall into a lower bin.

Because UV light is hazardous, in some arrangements the UV light can be contained within a housing to minimize exposure to humans in the vicinity. The housing may be made of any material that is opaque to UV light. For further safety, warning signs can also be posted so that people will not accidentally expose themselves to the UV light from the system of the present invention.

Figure 3:
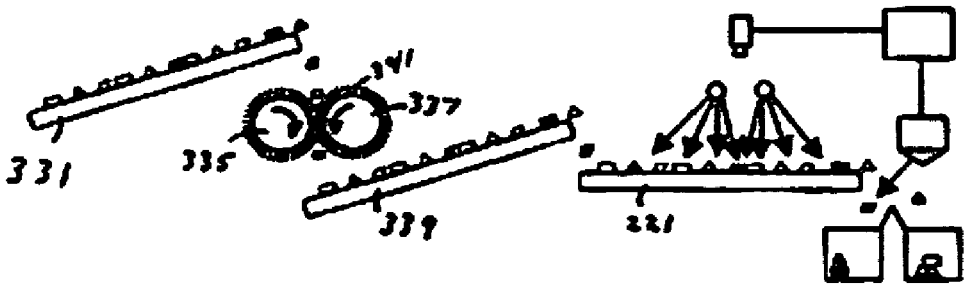
FIG. 3 shows an automated cleaning module in accordance with one aspect of the invention.

As discussed above, a small portion of a coating layer on the glass pieces 103, 105 can, in some embodiments, be removed to enable more accurate separation of the leaded glass 105 from the unleaded glass 103. With reference to an embodiment illustrated in FIG. 3, the glass 103, 105 is passed through a wire brush cleaning system before being exposed to the UV light. The glass 103, 105 is placed on a first conveyor belt 331 which drops the glass 103, 105 between two wire brush rollers 335, 337. The wire brush rollers 335, 337 are cylindrical in shape and have stiff metal bristles. As the glass 103, 105 passes between the wire brush rollers 335, 337 the bristles scratch through any coating that may exist to expose a small portion of the glass. The glass 103, 105 then falls onto a second conveyor belt 339 which transports the glass 103, 105 to the inspection conveyor belt 221.

Figure 4:
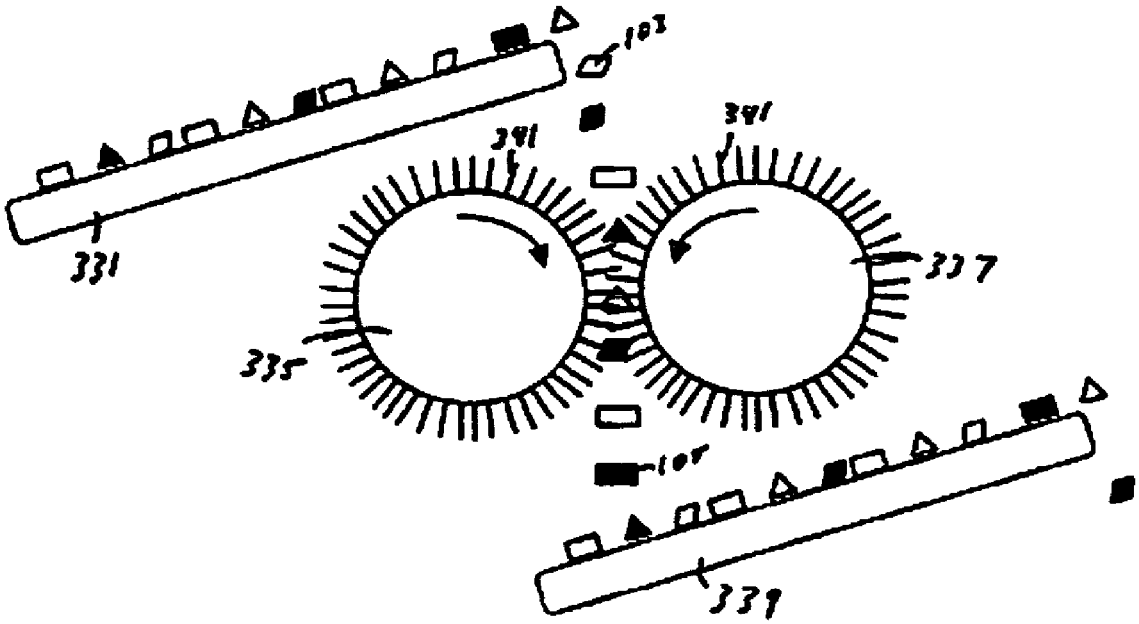
FIG. 4 shows the cleaning arrangement of FIG. 3 in greater detail.

FIG. 4 is a more detailed drawing of the wire brush rollers 335, 337. The left wire brush roller 335 rotates clockwise while the right wire brush roller 337 rotates counter clockwise. This rotation draws the glass pieces 103, 105 between the wire brush rollers 335, 337. There is a large area between the wire brush rollers 335, 337 where the bristles 341 overlap. This overlap forces the bristles 341 against the glass pieces 103, 105. This bristles 341 are typically made of stainless steel and have rough abrasive tips and sides. The force and motion of the abrasive bristles 341 against the glass 103, 105 results in scratches in any coatings that have been applied.

Figure 5:
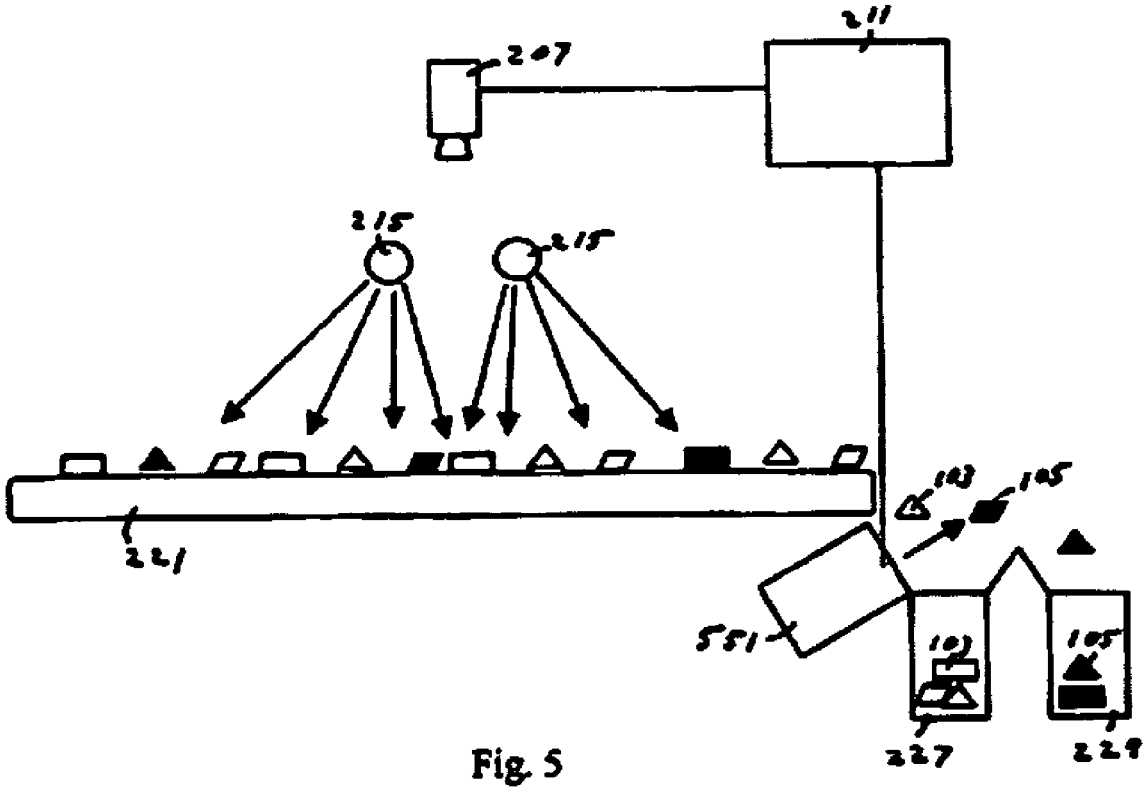
FIG. 5 shows an alternative sorting arrangement in accordance with the invention.

Although the inventive glass sorting system has been described with an array of air jets mounted over the conveyor belt it is also possible to have a similar sorting mechanism with an array of jets mounted under the conveyor belt. With reference to FIG. 5, an alternative sorting system includes an array of jets 551 mounted under the conveyor belt 221. The operation of this sorting system is similar to the system described with reference to FIG. 2. The difference between this alternative embodiment is that as the leaded glass pieces 105 fall off the end of the conveyor belt 221, the computer 211 actuates the array of jets 551 to emit jets that are angled upward to deflect the leaded glass 105 farther away from the end of the conveyor belt 221. This results in the leaded glass being diverted into a leaded glass bin 229 and the unleaded glass falling into an unleaded glass bin 227.

Although an optical leaded glass sorting system has been described above using specific wavelengths of light, it is also possible to perform subsequent separation based upon exposure to alternate wavelengths of light. For example, a subsequent screening can be performed using a 365 nm wavelength light source. The glass containing lead or other contaminants may emit light that the optical sensor may detect. The systems and methods described above may be used to separate glass containing other types of contaminants from uncontaminated glass.

With the glass sorted by lead content as well as other contaminants, the glass can be properly processed. Both leaded and unleaded glass can be recycled. While leaded glass can tolerate some unleaded glass in the recycling process, it is preferred that only minimal amounts of leaded glass are mixed with the unleaded glass. Thus, the leaded glass sorting algorithm may be adjusted to err conservatively by separating the glass as containing lead even if the observed 400-510 nm signal is weak. Similarly, if this system is used to detect other types of contaminants, it should be configured to err on the conservative side to avoid mixing any contaminated materials with uncontaminated materials. If the glass contains certain types of toxins it may be necessary to dispose of this glass using special hazardous material waste procedures. The inventive separation process allows the hazardous material waste to be properly identified and quantity of the hazardous material to be minimized.

The inventive system can detect the presence of leaded glass in a few milliseconds by simply detecting the 400-510 nm wavelength visible light. In at least some embodiments, conveyor speeds of up to 400 feet per minute can be used while still accurately separating the leaded and unleaded glass pieces. At these speeds air jets or other high speed sorting devices are necessary to process the volume of glass. Further, because the primary use for the inventive system is to detect glass types which emit visible light, the detection process is very fast and simple and in many if not all embodiments requires only a single scan.

Having fully described a preferred embodiment of the invention and various alternatives, those skilled in the art will recognize, given the teachings herein, that numerous alternatives and equivalents exist which do not depart from the invention. It is therefore intended that the invention not be limited by the foregoing description, but only by the appended claims.

I claim:

1. A method for identifying a contaminated glass piece from a plurality of glass pieces, comprising the steps of illuminating the plurality of glass pieces with UV light;

detecting light comprising fluoresced light at a specific wavelength in the visible spectrum emanating from the contaminated glass piece; and identifying the location of the contaminated glass piece based on detecting the fluoresced light at the specific wavelength only.

2. The method for identifying a contaminated glass piece of claim 1 further comprising the step of separating the contaminated glass piece from the plurality of glass pieces; wherein the contaminated glass piece comprises lead and the fluoresced light comprises light emitted by barium or strontium in the contaminated glass piece.

3. The method for identifying a contaminated glass piece of claim 2 further comprising the step:

placing the plurality of glass pieces on a moving conveyor belt.

4. The method for identifying a contaminated glass piece of claim 1 further comprising the step:

filtering the light emanating from the contaminated glass piece before the detecting step.

5. The method of claim 1 further including the step of cleaning the glass pieces prior to illumination.

* * * * *